US005651322A

United States Patent [19]

Koike

[11] Patent Number: 5,651,322

[45] Date of Patent: Jul. 29, 1997

[54] AUTOMATIC SEWING MACHINE WITH BOBBIN SUPPORT

[75] Inventor: Huji Koike, Nagoya, Japan

[73] Assignee: Royal Industries Co., Ltd., Aichi, Japan

[21] Appl. No.: 630,544

[22] Filed: Apr. 10, 1996

[30] Foreign Application Priority Data

Aug. 10, 1995 [JP] Japan ..... 7-009373 U

[51] Int. Cl.[6] ..... D05B 97/02

[52] U.S. Cl. ..... 112/169; 112/302

[58] Field of Search ..... 112/11, 169, 302, 112/224, 225, 259, 258

[56] References Cited

U.S. PATENT DOCUMENTS

| | | | |
|---|---|---|---|
| 2,594,534 | 4/1952 | Bell | 112/169 |
| 2,871,808 | 2/1959 | Matuzas | 112/302 |
| 2,900,941 | 8/1959 | Platt | 112/258 X |
| 3,420,198 | 1/1969 | Greulich | 112/259 X |
| 3,954,073 | 5/1976 | Varin | 112/259 |
| 4,079,684 | 3/1978 | Thomson | 112/169 X |
| 4,501,211 | 2/1985 | Seyama | 112/169 |
| 4,936,234 | 6/1990 | Jimenez et al. | 112/302 X |

FOREIGN PATENT DOCUMENTS

| | | | |
|---|---|---|---|
| 2636351 | 3/1990 | France | 112/169 |

*Primary Examiner*—Ismael Izaguirre
*Attorney, Agent, or Firm*—Koda and Androlia

[57] ABSTRACT

A miniature electric sewing machine includes a shaft support bracket mounted on one side of a casing, a rotatable shaft supported on the shaft support bracket for rotation so as to extend in parallel with the side surface of the casing, a spindle support arm fixed to the rotatable shaft, and a bobbin winder spindle fixed to a distal end of the spindle support arm so as to extend in parallel with the rotatable shaft. The spindle support arm has a length of 35 mm or more. The spindle support arm fixed to the rotatable shaft assumes a position where it is normal to the side face of the casing or another position where the bobbin winder spindle fixed to the distal end of the arm is directed obliquely downwardly. A stopper is formed on the spindle support arm to be abutted against the side face of the casing when the arm is normal to the casing side face, preventing further upward rotating movement of the arm from the normal position. A large diameter bobbin is loosely fitted onto the bobbin winder spindle and subsequently, a rubber ring is attached to the spindle for preventing the bobbin from falling off.

4 Claims, 3 Drawing Sheets

AUTOMATIC SEWING MACHINE WITH BOBBIN SUPPORT

BACKGROUND OF THE INVENTION

1. Field of the Invention

The present invention relates to an automatic sewing machine wherein not only dedicated small bobbins but also those of larger diameters such as mounted on spool pins of sewing machines for domestic use can be used.

2. Description of the Prior Art

The prior art has proposed an automatic sewing machine comprising a casing serving as a grip portion. A sewing table projects from one end of the casing. A sewing head is pivotally mounted on a rear end of the sewing table and including a sewing needle fastened to a front end thereof. A cloth presser lever has at a front end thereof a pressing portion which is pressed against an upper surface of the sewing table by a spring force. The cloth presser lever is pivotally mounted on the rear end of the sewing table together with the sewing head. An oscillation mechanism is provided for vertically oscillating the sewing head. A feed mechanism is provided on the underside of the front end of the sewing table to be operatively linked to the oscillation mechanism for feeding an object to be sewed by predetermined pitches, which object being held between the sewing table and the pressing portion of the cloth presser lever.

A dedicated small diameter bobbin on which a sewing thread is wound has been used in the above-described sewing machine. Since the dedicated bobbin has a diameter smaller those adapted for use in electric sewing machines for domestic use, the thread is used up in a short period of time. Accordingly, the bobbin needs to be replaced with another every time the thread has been used up, or the bobbin needs to be detached so that another thread is wound thereon again. Thus, since the handling of the sewing machine is troublesome and sewing cannot be efficiently performed, the usability of the sewing machine is low.

SUMMARY OF THE INVENTION

Therefore, an object of the present invention is to provide an automatic sewing machine wherein not only dedicated small bobbins but also those of larger diameters such as mounted on spool pins of sewing machines for domestic use can be used.

Another object of the present invention is to provide an automatic sewing machine wherein the larger diameter bobbin can be prevented from being unnecessarily moved by a tension caused when the thread is drawn out from the bobbin.

Further another object of the present invention is to provide an automatic sewing machine wherein the larger diameter bobbin can be prevented from falling off a bobbin winder spindle.

The present invention provides an automatic sewing machine comprising a casing including a grip portion. A sewing table projects from one end of the casing. A sewing head is pivotally mounted on a rear end of the sewing table and includes a sewing needle fastened to a front end thereof. A cloth presser lever has at a front end thereof a pressing portion which is pressed against an upper surface of the sewing table by a spring force. The cloth presser lever is pivotally mounted on the rear end of the sewing table together with the sewing table. An oscillation mechanism is provided for vertically oscillating the sewing head. A feed mechanism is provided on the underside of the front end of the sewing table to be operatively linked to the oscillation mechanism for feeding an object to be sewed by predetermined pitches, which object being held between the sewing table and the pressing portion of the cloth presser lever. A shaft support bracket is provided on one side of the casing. A rotatable shaft is rotatably supported on the shaft support bracket so as to extend in parallel with the side surface of the casing. A spindle support arm is fixed to the rotatable shaft. A bobbin winder spindle is provided on a distal end of the spindle support arm so as to extend in parallel with the rotatable shaft. The bobbin winder spindle and the spindle support arm are dimensioned so that a bobbin of a large diameter adapted to be mounted on spool pins of at least sewing machines for home use is rotatably mounted thereon.

According to the above-described construction, a large diameter bobbin for use in the sewing machines for home use can be rotatably mounted on the bobbin winder spindle provided on the distal end of the spindle support arm. Consequently, since a long time drive of the automatic sewing machine necessitates no resupply of thread, sewing can be efficiently performed and accordingly, the usability of the sewing machine can be improved.

In a preferred form of the present invention, the spindle support arm includes a stopper abutted against the side surface of the casing, the stopper preventing upward pivotal movement of the spindle support arm when assuming a position where the same is normal to the side surface of the casing. Consequently, an oscillatory movement of the spindle support arm due to the tension caused when the thread is drawn out can be limited to such a level that an angle of the stopper to the side surface of the casing is below a right angle.

In further another preferred form of the present invention, the automatic sewing machine further comprises a rubber ring fitted on the bobbin winder spindle for preventing the bobbin from falling off the spindle. Consequently, the large diameter bobbin can be prevented from falling off even when the automatic sewing machine in inclined during its use.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENT

Figure 1:
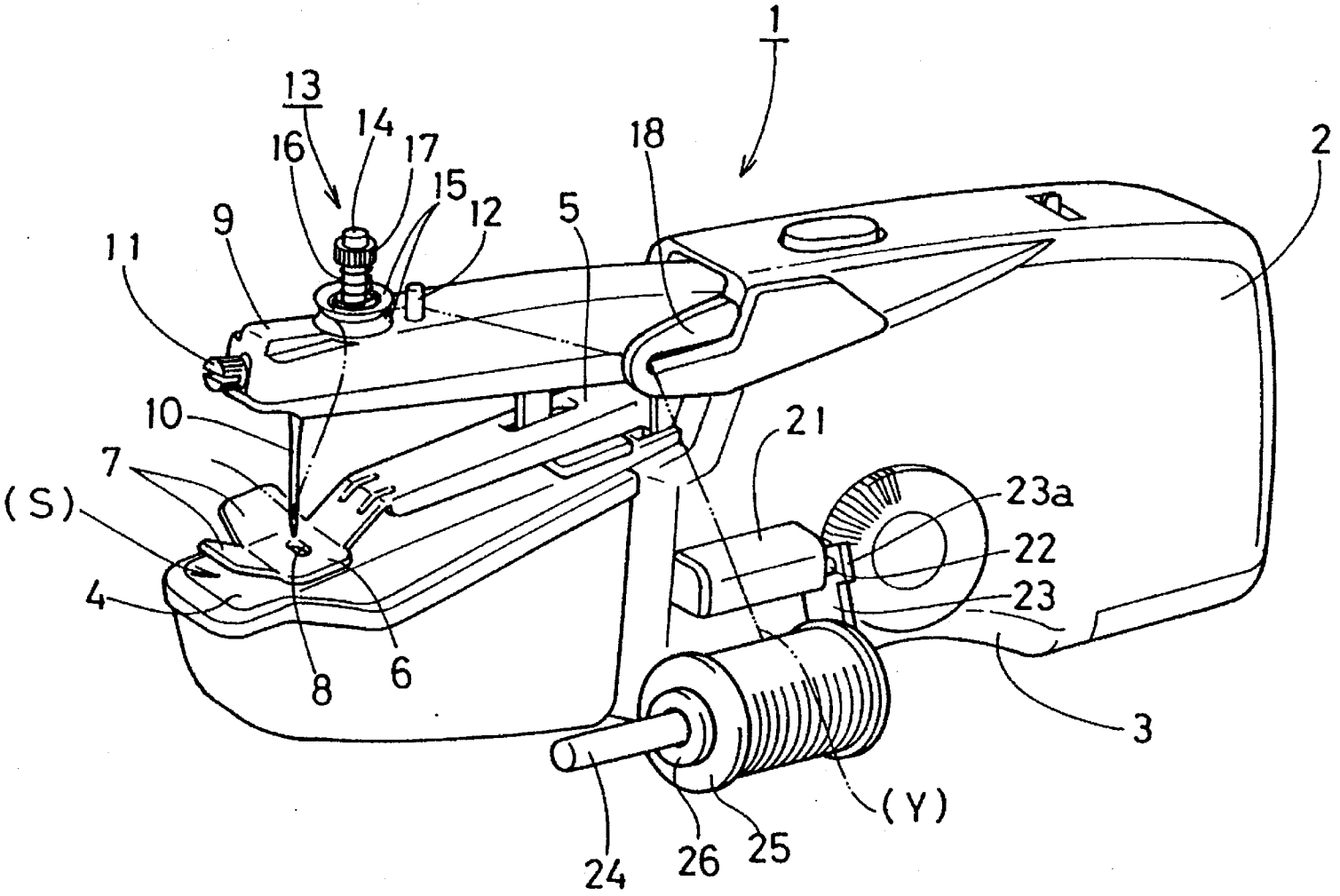
FIG. 1 is a perspective view of an automatic sewing machine of one embodiment in accordance with the present invention.
Figure 2:
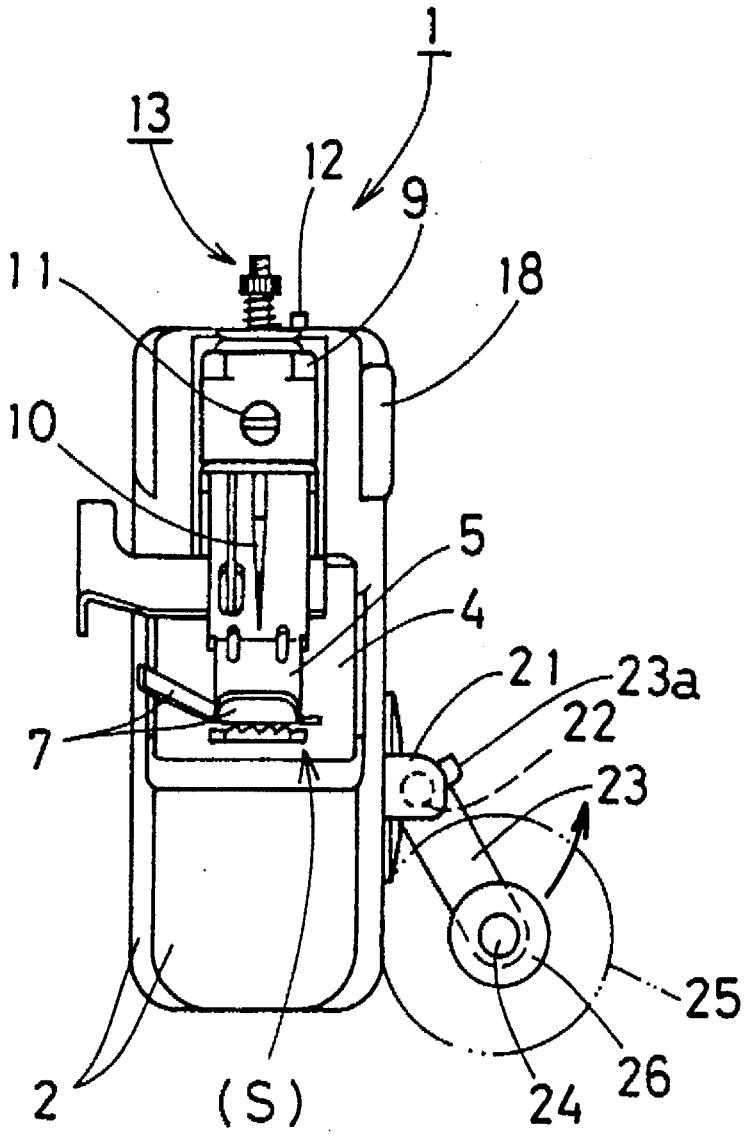
FIG. 2 is a front view of the sewing machine.

One embodiment of the present invention will be described with reference to the accompanying drawings. Referring to FIG. 1, an automatic sewing machine 1 of the embodiment is shown. A casing 2 is formed on its outer periphery a grip portion 3 which can be gripped in one hand of a user to be held. A sewing table 4 is fixed to one end of the casing 2 to be disposed to be obliquely inclined such that its front end is located lower. A cloth presser lever 5 and a sewing head 9 are provided on the sewing table 4. The cloth presser lever 5 has a pressing portion 6 and a guide strip 7 both formed by bending a front end thereof. The pressing portion 6 has a through hole 8 formed to correspond to a needle hole (not shown) of the sewing table 4. The sewing head 9 is disposed on the upper face of the cloth presser lever 5 and pivotally mounted together with the lever 5 on a shaft (not shown) further mounted on the sewing table 4. A return spring (not shown) is provided so that both ends thereof are engaged with the inside surface of the sewing table 4 and the cloth presser lever 5 respectively, whereupon the pressing portion 6 of the cloth presser lever 5 is pressed on a sewing position S of the sewing table 4.

A needle 10 is inserted into a hole (not shown) formed in the underside of the front end of the sewing head 9 to be fixed in position by a clamp screw 11. A thread guide pin 12 and a thread tension adjuster 13 are provided on the upper face of the front end of the sewing head 9. The thread tension adjuster 13 comprises two dish-shaped discs 15 loosely fitted with a screw 14 secured to the upper face of the sewing head 9, a presser spring 16 encompassing the screw 14, and an adjusting nut 17 screwed onto the screw 14. The, sewing head 9 further has a thread guide 18 centrally formed on one side face thereof.

A shaft support bracket 21 is formed on the side of the casing 2 on which the thread guide 18 is formed. A rotatable shaft 22 is rotatably supported on the shaft support bracket 21 so as to extend in parallel with the side surface of the casing 2. A spindle support arm 23 having a length of 35 mm or more is fixed to one end of the rotatable shaft 22. A bobbin winder spindle 24 is fixed to a distal end of the spindle support arm 23 so as to extend in parallel with the rotatable shaft 22. As the rotatable shaft 22 is rotated, the spindle support arm 23 fixed thereto assumes a position where it is normal or at a right angle to the side face of the casing 2 or another position where the bobbin winder spindle 24 fixed to the distal end of the arm 23 is directed obliquely downwardly. A stopper 23*a* is formed on the spindle support arm 23 to be abutted against the side surface of the casing 2 when the arm 23 is normal to the casing side face, thereby preventing further upward pivotal movement of the arm 23 from the normal position. A large diameter bobbin 25 (see FIG. 3A) such as mounted on spool pins of electric sewing machines for home use is loosely fitted onto the bobbin winder spindle 24 and thereafter, a rubber ring 26 is attached to the spindle 24 for preventing the bobbin 25 from falling off.

A feed mechanism (not shown) is provided under the sewing table 4 in the casing 2 for feeding an object (not shown) to be sewed by predetermined pitches. An oscillation mechanism (not shown) is incorporated in the casing 2 to be driven by a DC motor (not shown) for vertically oscillating the sewing head 9. The object is held on the sewing position S between the sewing table 4 and the pressing portion 6 of the cloth presser lever 5. The feed mechanism is operatively linked to the oscillation mechanism to feed the object in the above-described condition by the predetermined pitches in the direction crossing the sewing table 4. Since both of the feed mechanism and the oscillation mechanism are conventional, neither mechanism is shown in the drawings and will not be further described.

One end of a machine sewing thread Y wound on the large diameter bobbin 25 loosely fitted on the bobbin winder spindle 24 is drawn out to be caused to pass through the thread guide 18. Passing the thread guide pin 12 and between the discs 15 of the thread tension adjuster 13 in turn, the thread Y is further caused to pass through an eye of the needle 10. The pressing portion 6 of the cloth presser lever 5 is caused to depart above the sewing position S and then, the object to be sewed is set at the sewing position S on the sewing table 4. The cloth presser lever 5 is returned so that the object is pressed on the sewing position S by the pressing portion 6. The sewing head 9 is then oscillated so that sewing is carried out.

Figure 3B:
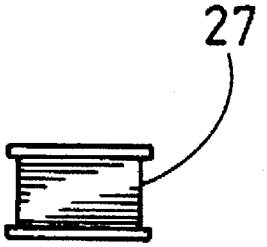
FIGS. 3A and 3B are front views of large and small bobbins both used with the automatic sewing machine, respectively.
Figure 3A:
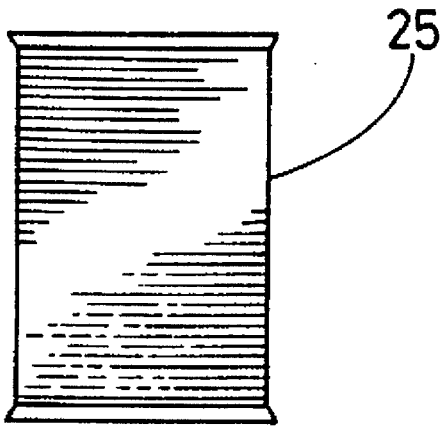

In the above-described handy sewing machine, when a large tension applied to the thread during the sewing retards drawing-out of the thread Y, the large diameter bobbin 25 is pulled such that the spindle support arm 23 fixed to the rotatable shaft 22 is pivotally moved upwardly. Consequently, since the tension is instantaneously eased, the thread Y can be prevented from being cut off. A small diameter bobbin 27 such as shown in FIG. 3B may be mounted on the bobbin winder spindle 24 as well as the above-described large diameter bobbin 25.

According to the above-described handy automatic sewing machine, a large diameter bobbin such as used in the sewing machines for home use can be rotatably mounted on the bobbin winder spindle provided on the distal end of the spindle support arm. Consequently, since a long time drive of the automatic sewing machine necessitates no resupply of thread, sewing can be efficiently performed and accordingly, the usability of the sewing machine can be improved.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

What is claimed is:

1. An automatic sewing machine comprising:

a casing including a grip portion;

a sewing table projecting from one end of the casing;

a sewing head pivotally mounted on a rear end of the sewing table and including a sewing needle fastened to a rear end thereof;

a cloth presser lever having at a front end thereof a pressing portion which is pressed against an upper surface of the sewing table by a spring force, the cloth presser lever being pivotally mounted on the rear end of the sewing table together with the sewing table;

an oscillation mechanism for vertically oscillating the sewing head;

a feed mechanism provided on the underside of the front end of the sewing table to be operatively connected to the oscillation mechanism for feeding an object to be sewed by predetermined pitches, the object being held between the sewing table and the pressing portion of the cloth presser lever;

a shaft support bracket provided on one side of the casing;

a rotatable shaft rotatably supported on the shaft support bracket so as to extend in parallel with the side surface of the casing;

a spindle support arm fixed to the rotatable shaft; and a bobbin winder spindle provided on a distal end of the spindle support arm so as to extend in parallel with the rotatable shaft, the bobbin winder spindle and the spindle support arm being dimensioned so that a bobbin of a large diameter is rotatably mounted thereon.

2. An automatic sewing machine according to claim 1, wherein the spindle support arm includes a stopper abutted against the side surface of the casing, the stopper preventing upward pivotal movement of the spindle support arm when assuming a position where the same is normal to the side surface of the casing.

3. An automatic sewing machine according to claim 1, further comprising a rubber ring fitted on the bobbin winder spindle for preventing the bobbin from falling off the spindle.

4. An automatic sewing machine according to claim 2, further comprising a rubber ring fitted on the bobbin winder spindle for preventing the bobbin from falling off the spindle.

* * * * *